US005601318A

United States Patent [19]

Rusing

[11] Patent Number: 5,601,318

[45] Date of Patent: Feb. 11, 1997

[54] NECKTIE KNOT TYING DEVICE

[76] Inventor: Robert M. Rusing, 4304 E. Campbell, #2054, Phoenix, Ariz. 85018

[21] Appl. No.: 541,271

[22] Filed: Oct. 12, 1995

[51] Int. Cl.[6] ..... A47G 25/90; A41D 25/08

[52] U.S. Cl. ..... 289/17; 223/82; 223/111; 2/152.1

[58] Field of Search ..... 289/2, 17, 18.1; 2/144, 148, 149, 152.1; 223/80, 81, 82, 111, 118, 50

[56] References Cited

U.S. PATENT DOCUMENTS

| | | | |
|---|---|---|---|
| 1,655,752 | 1/1928 | Coe . | |
| 2,148,582 | 2/1939 | Rodgers | 223/111 |
| 2,208,695 | 7/1940 | Fallon | 223/111 |
| 2,491,702 | 12/1949 | Arnold | 289/17 |
| 2,899,226 | 8/1959 | Lint | 289/17 |
| 3,168,912 | 2/1965 | Marica | 140/101 |
| 3,510,032 | 5/1970 | Carver | 223/111 |
| 3,575,449 | 4/1971 | Browning | 289/1.5 |
| 3,625,556 | 12/1971 | Stromberg | 289/17 |
| 3,630,555 | 12/1971 | Newlin | 289/17 |
| 3,752,374 | 8/1973 | Pro | 223/111 |
| 3,837,691 | 9/1974 | Smythe | 289/17 |
| 3,883,052 | 5/1975 | Wilson | 223/111 |
| 3,965,605 | 6/1976 | Allen | 289/17 |
| 4,573,718 | 3/1986 | Stiver | 289/17 |
| 4,641,652 | 2/1987 | Hutterer et al. | 289/17 |
| 4,815,772 | 3/1989 | Lizarraga | 289/1.5 |

FOREIGN PATENT DOCUMENTS

| | | | |
|---|---|---|---|
| 81962 | 1/1957 | Denmark | 2/144 |
| 606155 | 8/1948 | United Kingdom | 223/118 |

*Primary Examiner*—Michael A. Neas
*Attorney, Agent, or Firm*— Schmeiser, Olsen & Watts

[57] ABSTRACT

A necktie knot tying tool having an elongate body with a handle at one end and a tie finishing portion at the other end. A raised projection extends outwardly from the tool between the two ends for placement beneath the final loop formed when tying a necktie. The projection has a textured surface as does the tie finishing portion to limit slippage of the tie over those portions of the tool. An indent in the top of the raised projection aids in the formation of a crease in the tie below the knot.

10 Claims, 2 Drawing Sheets

NECKTIE KNOT TYING DEVICE

FIELD OF THE INVENTION

The present invention relates to knot tying tools and methods of use. More specifically, the subject invention is a knot tying tool utilized in the tying of a necktie.

BACKGROUND OF THE INVENTION

The history of neckties dates back 300 years to a Croatian regiment which had just won a victory over Turkey. The regiment presented themselves to King Louis XIV wearing brightly colored silk handkerchiefs around their necks. The king was so impressed he created a regiment of Royal Cravats. Many variations have led to the present day necktie, an integral part of the wardrobe of men in certain parts of the world.

In addition to the tie itself, the method of tying ties has also evolved into the current three most used knot methods: the four-in-hand, the half-Windsor and the Windsor or full Windsor.

The necktie wearer has faced three problems related to the art of tying a necktie: efficiency, consistency and precision. These problems are exacerbated by the fact that depending upon the type of tie, especially its width, material thickness and material type, one needs to change either the type of knot which is used or the tightness of the knot in order to obtain an appropriate appearance. For example, with a thick material type tie, tying a full Windsor knot can often result in an unacceptably large knot. To overcome this, one may try to tighten the tie, however, doing so will often distort the shape of the knot. Alternatively, one may try to tie a four-in-hand or half-Windsor, however, tying these knots often results in a knot which is not symmetrical.

The inventions presently available such as that disclosed by Lizzaraga, in U.S. Pat. No. 4,815,772, help to teach the knot tying method so that the wearer can improve his technique in necktie knot tying. However, even with the Lizzaraga tool the necktie wearer still faces the problem of forming a proper knot. Various solutions to this problem have been attempted.

For example, some people attempt to hold the front knot portion while pulling on the frontal strand to prevent pulling the interior of the knot below the front of the knot. Holding the knot, however, creates tension variations which prevent the formation of a symmetrical knot. Alternatively, some may put their index finger in the final loop, holding it there as they pull down on the frontal strand. This second procedure is more effective than merely holding the front portion. However, using one's finger is inconvenient as it virtually incapacitates the use of the hand and, furthermore, if the necktie is pulled tight, it may be hard to extract one's finger without dislodging the knot. In addition, there is always a concern about catching a nail on the tie and causing a pull which can occur very easily, especially with silk ties. Accordingly, the current invention was developed in order to solve these problems.

SUMMARY

The current invention is a neckwear finishing tool utilized in the final stage of the necktie tying process. This invention is a solution to the problem of pulling the interior part of the knot down under the front portion of the necktie. This will accomplish the purpose of accentuating the shape of the necktie knot.

The subject invention overcomes these problems through the use of an elongate tool having a handle portion toward one end and a projection extending outwardly from the body of the tool toward the other end. Proceeding from the disc-like projection to the closest end of the tool, the tool is shaped like a rod and at the very end there is a stop which prevents the tie from unintentionally slipping off during use.

The tie engaging parts of the device have a textured finish so as to add additional friction as the tie is pulled tight. This textured surface is most importantly located on the projection as well as on the rod portion of the tool.

The projection is the site for the first tightening of the tie with the last loop of the tie extending over the projection. In an alternate embodiment the projection can have a semi "V" shaped indent centrally located in the top of the projection, thus aiding in the forming of a crease in the center of the tie below the knot.

The finishing of the knot is accomplished on the rod-like portion of the tool as the knot is pulled tight.

In use, the tool extends completely through the last loop of the tie. Accordingly, the relationship between the last loop as it is pulled tight and the sides of the tie is kept constant since the pressure on either side of the knot is equal due to the fact that the tool rests upon either side of the knot. The texturing of the projection prevents the tie from slipping in an uncontrolled fashion and thus adds to the precision and the consistent results obtainable with the subject invention.

As the knot is finished on the rod-like portion of the tool, the extension of the tool across either side of the knot again aids in the achieving of a symmetrical knot even where a half-Windsor or similar knot is used. The stop at the end of the tool prevents the unwanted removal of the tool during the tying process. However, the incline on the stop is such that once the knot is tied to its preferred tightness the tool can be easily slipped out from beneath the final loop.

In operation, as the user arrives at the final stage of tying the knot of the necktie, he inserts the tool into the final loop of the necktie and locates the projection centrally inside the loop. The user holds the tool horizontally with one hand with the projection extending upwardly, while pulling down on the frontal strand of the necktie as he would do in a normal necktie knot tying procedure. The projection is so shaped as to allow the fabric of the tie to be evenly draped to obtain the proper shape of a necktie knot. The surface of said projection is also textured to provide added friction and prevent any uncontrolled slipping of the necktie fabric. The knot thus forms properly without the inner portion of the knot dropping under the final loop. In an optional step the tool may be rotated about ninety degrees such that the projection is extending toward the user's neck after which another tightening step may be performed. The user then pulls the projection out so that the final loop is located about the finishing, rod-like, portion of the tool which allows the user to pull down again for a final tightening of the knot. The final knot is crisp and hard and is properly draped with the desired dimple or crease forming in the middle of the necktie, which also helps the tie to billow creating a fullness in the tie.

DETAILED DESCRIPTION OF THE PREFERRED EMBODIMENT

Figures 1, 3, 4:
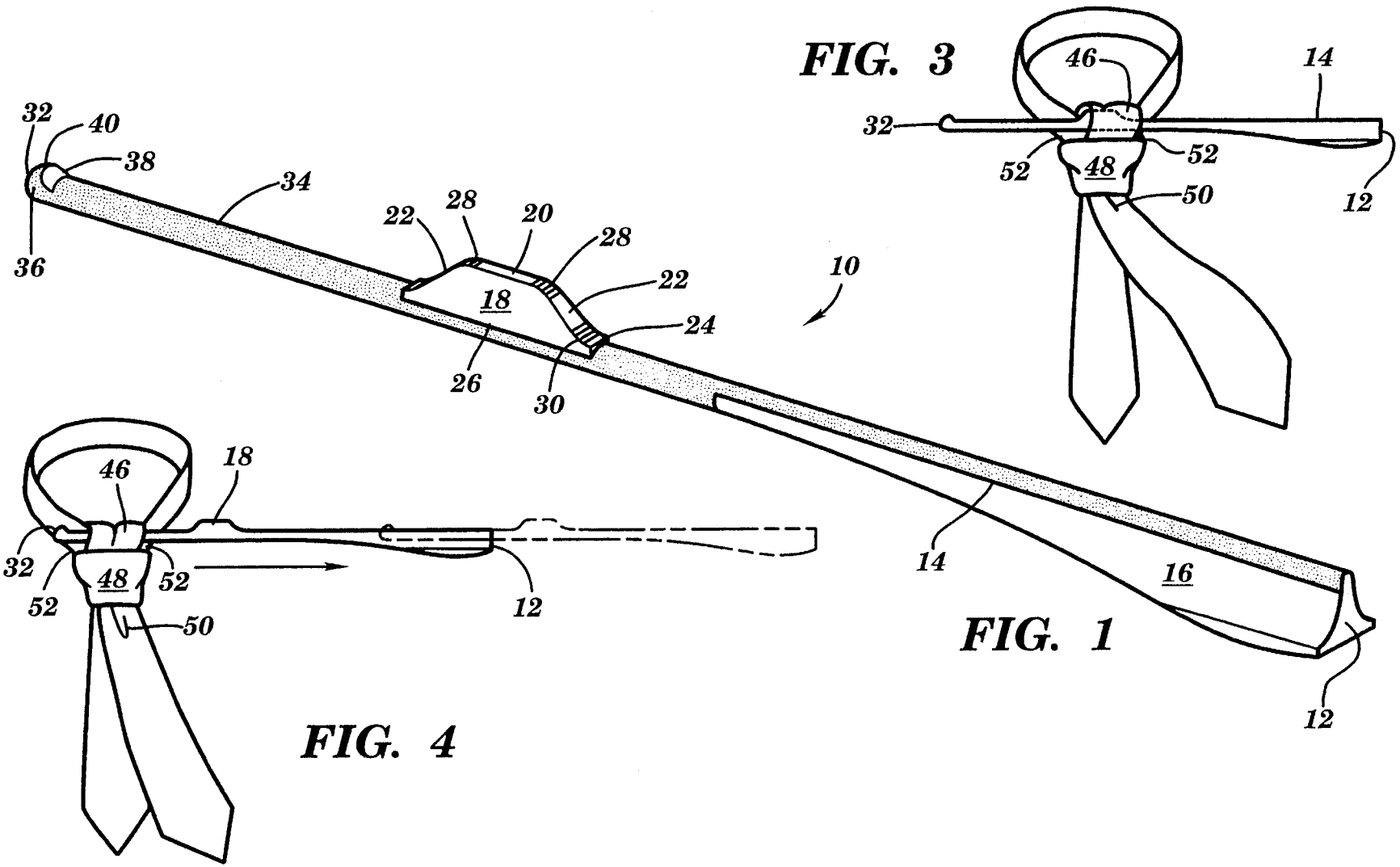
FIG. 1 is a perspective view of the tool showing the entire length, and also showing the raised projection.
FIG. 3 is a side elevational view of the invention positioned for the final tightening of the knot and with the removal of the tool shown in phantom.
FIG. 4 is a perspective view of an alternate embodiment.

FIG. 1 discloses the knot tying tool generally designated as 10. The tool is essentially elongate. In its preferred embodiment the tool is 10 3/16 inches from one end to the other. At the first end 12 there is a handle 14. The handle has thumb rests 16 on either side of the handle, which thumb rests are curved to allow the user to firmly hold the tool 10 in either the left or right hand.

A projection 18 is integral with tool 10 and is raised so as to extend upward from the tool. The projection has a top 20 and side walls 22. The side walls slope downwardly from the top 20 to the main body of the tool 10 forming a smooth incline from the tool body to the top. In the preferred embodiment, the distance from the first end 12 to the beginning of the sidewall at 24 is 5 11/16 inches. With the length of the projection being 1½ inches at its base 26. The transition points from the side walls to the top are rounded at 28 so as to allow the final loop of the necktie to smoothly drape over the top 20 of the projection 18.

The side walls 22 and the top 20 are textured as shown at 30. Toward the second end 32 of the tool is a rod-like portion 34 which is also textured. The preferred length from the projection to the second end is approximately 3 inches. At the second end 32 there is a nub 36 which forms a stop that prevents the unintentional slipping of the tie from off of the tool.

The nub 36 has a slope 38 which extends from the rod-like portion 34 up to the nub top 40. This allows the tool to be easily withdrawn after the necktie knot is pulled tight. The outermost portion of the second end 32 is rounded to facilitate the insertion of the tool through the final necktie loop.

Figure 2:
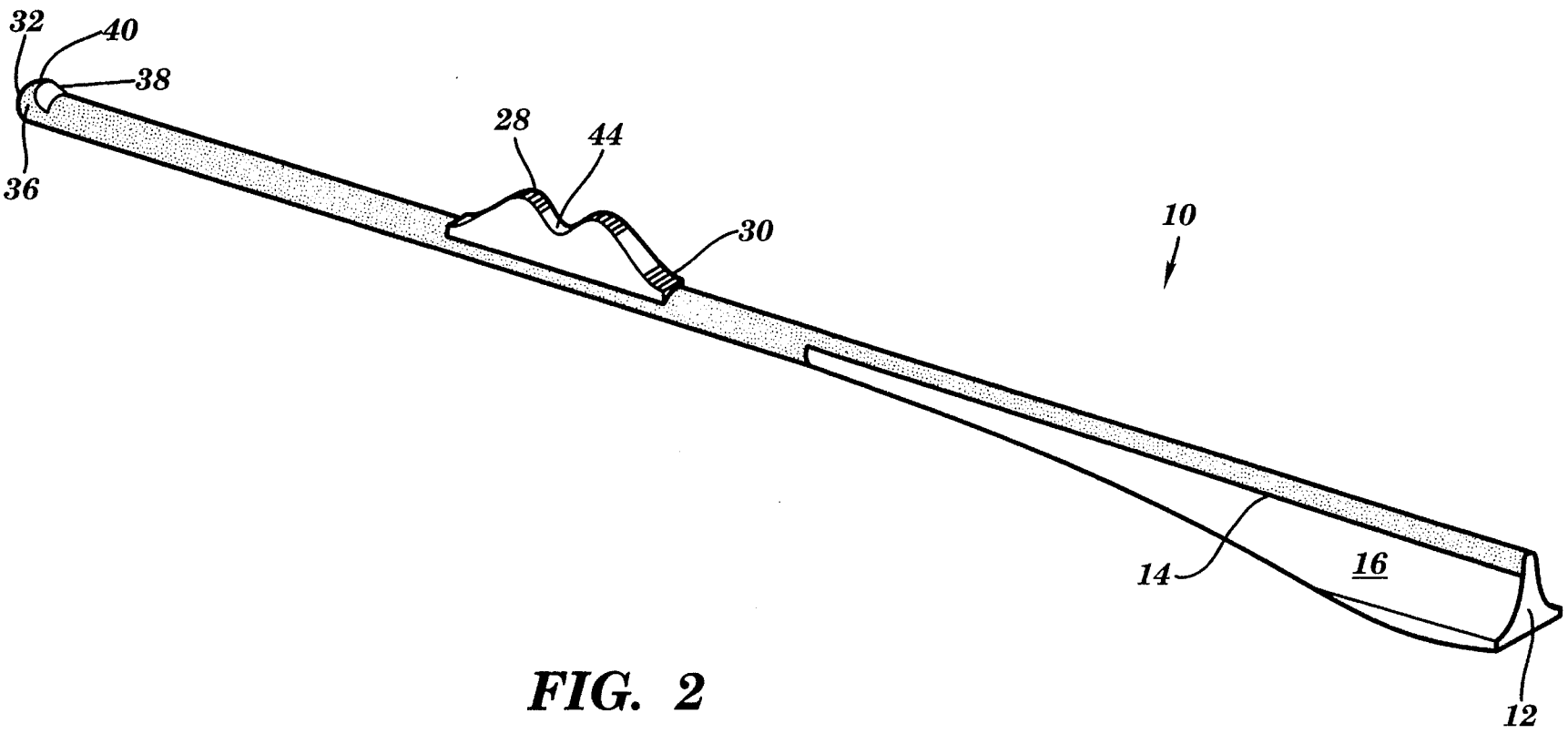
FIG. 2 is a side elevational view of the invention positioned for the first tightening of the knot.

As shown in FIG. 2, the top 20 of the projection 18 may have an indent or dimple 44 which is essentially "V" shaped.

As shown in FIG. 3, in a common necktie tie such as a four-in-hand, half Windsor or full Windsor there is a final loop 46 which is formed when the tie is looped around the rear portion of the knot and inserted through the front portion 48.

With the projection 18 centered substantially in the middle of the tie, one may pull the tie tightly with the projection extending upward as shown in FIG. 3. Where the alternate embodiment is used, the indent 44 will help form a crease 50 directly below the front portion 48 of the knot.

If preferred, the user may rotate the tool such that the projection extends backward toward the user and pull a second time to further tighten the knot while maintaining the final loop 46 above the front portion 48.

The tool is then partially withdrawn such that the final loop 46 extends around the rod-like portion 44. The user again pulls the tie to tighten the knot. Because the tool extends across the ends 52 of the knot, the knot will tend to form symmetrically and the final loop will be prevented from slipping to one side.

Once completed, the tool is removed as shown in phantom in FIG. 4 with the final loop riding up the slope of the nub 38, thus allowing the tool to be removed without substantially loosening the knot.

While the surface of the projection 18 and the rod-like portion 34 may be textured to stabilize the material, it should be appreciated that the texturized surface is not of the type which would in any way catch on the tie. Thus, except for the texturizing, the tool is essentially smooth and may be made of any suitable material including wood, plastic, metal or other material which is sufficiently strong.

While the above describes the preferred embodiment of the invention, it should be appreciated that numerous variations may be made without departing from the scope of the invention which is intended to be limited only by the appended claims.

I claim:

1. A tool for aiding in the tying of a necktie knot comprising:

a) a substantially rigid elongate bar having a handle portion toward one end and a rod-like knot finishing portion toward the other end; and b) a raised disc-like projection integral with said tool, said projection located between said handle and said finishing portion, said projection extending outwardly from said tool and having a base, sloping side walls, a top, and a rounded transition portion from the sidewalls to the top, said side walls forming a smooth incline from the bar to the top of the projection, the base of said projection being about 1.5 inches in length.

2. A tool for aiding in the tying of a necktie knot comprising;

a) a substantially rigid elongate bar having a handle portion toward one end and a rod-like knot finishing portion toward the other end; and b) a raised projection integral with said tool, said projection located between said handle and said finishing portion, said projection extending outwardly from said tool and having sloping sidewalls and a top, said sidewalls forming a smooth incline from the bar to the top of the projection, said projection having a textured surface for increasing friction between the projection and a tie sliding there over.

3. The invention of claim 1 wherein the end of the tool adjacent the rod-like portion has an outermost surface which is rounded to facilitate insertion of the tool into a partially tied tie knot.

4. The invention of claim 3 further comprising a stop toward the end of the tool adjacent the rod-like portion.

5. A tool for aiding in the tying of a necktie knot comprising:

a) a substantially rigid elongate bar having a handle portion toward one end and a rod-like knot finishing portion toward the other end;

b) a raised projection integral with said tool, said projection located between said handle and said finishing portion, said projection extending outwardly from said tool and having sloping sidewalls and a top, said sidewalls forming a smooth incline from the bar to the top of the projection, the end of the tool adjacent to the rod-like portion having an outermost surface which is rounded to facilitate insertion of the tool into a partially tied tie knot; and a stop adjacent to the rod-like portion, wherein the stop is a nub at the rounded end of the tool, said nub having an incline surface from the top of the nub to the rod-like portion to facilitate removal after the knot is tied.

6. A tool for aiding in the tying of a necktie knot comprising:

a) a substantially rigid elongate bar having a handle portion toward one end and a rod-like knot finishing portion toward the other end; and b) a raised projection integral with said tool, said projection located between said handle and said finishing portion, said projection having sloping side walls and a top, and an indent in the top of said projection.

7. The invention of claim 6 wherein said projection has a textured surface for increasing friction between the projection and a tie sliding there over.

8. The invention of claim 7 wherein the sidewalls of said projection slope from the top of the projection to the bar forming a smooth incline.

9. The invention of claim 8 further comprising a stop toward the end of the tool adjacent the rod-like finishing portion.

10. An improvement in the method of tying a necktie knot of a type wherein the final step of the knot forming process includes looping the tie in a final loop around the rear portion of the knot and inserting it through the front portion of the knot, said improvement comprising:

a) inserting a substantially rigid elongate bar having a raised projection integral with said bar through said final loop;

b) locating the raised projection under said loop and centering the projection substantially at the middle of the loop;

c) pulling the necktie tight about said projection;

d) partially removing said tool such that a rod-like finishing portion toward one end of the tool lies beneath the final loop; e) secondary pulling of the tie tight about the finishing portion; and f) removing the tool from within said final loop.

* * * * *